US010872552B2

(12) United States Patent
Minaki et al.

(10) Patent No.: US 10,872,552 B2
(45) Date of Patent: Dec. 22, 2020

(54) DEVICE AND METHOD FOR SUBPIXEL RENDERING

(71) Applicant: SYNAPTICS INCORPORATED, San Jose, CA (US)

(72) Inventors: Tomoo Minaki, Tokyo (JP); Hirobumi Furihata, Tokyo (JP); Takashi Nose, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 52 days.

(21) Appl. No.: 16/193,975

(22) Filed: Nov. 16, 2018

(65) Prior Publication Data

US 2019/0156727 A1 May 23, 2019

(30) Foreign Application Priority Data

Nov. 20, 2017 (JP) ..... 2017-222918

(51) Int. Cl.
*G09G 3/20* (2006.01)
*G09G 3/3208* (2016.01)
*G09G 3/36* (2006.01)

(52) U.S. Cl.
CPC ..... *G09G 3/2003* (2013.01); *G09G 3/2074* (2013.01); *G09G 3/2092* (2013.01); *G09G 3/3208* (2013.01); *G09G 3/3607* (2013.01); *G09G 2300/0426* (2013.01); *G09G 2300/0452* (2013.01); *G09G 2310/027* (2013.01); *G09G 2310/0275* (2013.01);
(Continued)

(58) Field of Classification Search
CPC .. G09G 3/2003; G09G 3/2074; G09G 3/2092; G09G 3/3208; G09G 3/3607; G09G 2300/0426; G09G 2300/0452; G09G 2310/027; G09G 2310/0275; G09G 2340/0457; G09G 2360/18; G09G 2370/08
See application file for complete search history.

(56) References Cited

U.S. PATENT DOCUMENTS 6,243,070 B1 * 6/2001 Hill ..... G02F 1/133516 345/589
7,248,268 B2 * 7/2007 Brown Elliott ..... G09G 5/02 345/589
(Continued)

FOREIGN PATENT DOCUMENTS

JP 2007532999 A 11/2007

*Primary Examiner* — Amare Mengistu
*Assistant Examiner* — Jennifer L Zubajlo
(74) *Attorney, Agent, or Firm* — Patterson + Sheridan, LLP

(57) ABSTRACT

A display driver comprises: subpixel rendering (SPR) circuitry configured to use, in SPR, predetermined regions which fall within two lines of input subpixels of an input image; buffer memory circuitry configured to store first subpixel data for a plurality of first subpixels of the input subpixels, wherein the plurality of the first subpixels each are encompassed in the predetermined regions; and a register configured to store coefficients, wherein the coefficients respectively correspond to shapes of the portions of the first subpixels encompassed in the predetermined regions. The SPR circuitry is configured to calculate second subpixel data for second subpixels of an output image, based on the first subpixel data stored in the buffer memory circuitry and the coefficients stored in the register.

22 Claims, 28 Drawing Sheets

(52) U.S. Cl.
CPC . *G09G 2340/0457* (2013.01); *G09G 2360/18* (2013.01); *G09G 2370/08* (2013.01)

(56) References Cited

U.S. PATENT DOCUMENTS 7,283,142 B2 * 10/2007 Credelle ..... G09G 3/20 345/589
7,598,965 B2 10/2009 Brown Elliott et al.
7,755,652 B2 * 7/2010 Credelle ..... G09G 3/3607 345/694
7,920,154 B2 4/2011 Brown Elliott et al.
8,018,476 B2 * 9/2011 Credelle ..... G09G 3/2074 345/690
8,390,646 B2 3/2013 Brown Elliott et al.
8,471,787 B2 * 6/2013 Ihata ..... G09G 3/3208 345/76
9,318,057 B2 * 4/2016 Tanaka ..... G09G 3/3406
10,074,301 B2 * 9/2018 Chen ..... G09G 3/3208
10,373,540 B2 * 8/2019 Yang ..... G09G 3/2003
2003/0034992 A1 * 2/2003 Brown Elliott ..... G09G 5/006 345/690
2003/0085906 A1 * 5/2003 Elliott ..... G09G 3/20 345/613
2003/0103058 A1 * 6/2003 Hellen Brown Elliott ..... G09G 3/2003 345/589
2004/0196297 A1 * 10/2004 Elliott ..... G06F 3/14 345/613
2010/0118045 A1 * 5/2010 Brown Elliott ..... H04N 13/324 345/589
2010/0149204 A1 * 6/2010 Han ..... G09G 5/02 345/589
2013/0088528 A1 * 4/2013 Borgers ..... G09G 3/3648 345/690
2016/0293084 A1 * 10/2016 Guo ..... G09G 3/2003
2018/0130395 A1 * 5/2018 Yang ..... G09G 3/2003

* cited by examiner

A+B+C+D=E+F+G+H=I+J+K+L=M+N+O+P+Q+R

A+D=B+C=E+H=F+G=I+L=J+K=M+Q+O=P+N+R

Fig. 18A

1ST SUBPIXEL OF 1ST ROW OF OUTPUT IMAGE

SUBPIXEL DATA STORED IN BUFFER MEMORY FOR SIX SUBPIXELS OF INPUT IMAGE

| | | |
|---|---|---|
| 0 | 0 | 0 |
| 0 | R11 | R12 |

×

ASSOCIATED COEFFICIENTS

| | | |
|---|---|---|
| 4 | 14 | 0 |
| 4 | 14 | 0 |

Fig. 18B

2ND SUBPIXEL OF 1ST ROW OF OUTPUT IMAGE

SUBPIXEL DATA STORED IN BUFFER MEMORY FOR SIX SUBPIXELS OF INPUT IMAGE

| | | |
|---|---|---|
| 0 | 0 | 0 |
| R11 | R12 | R13 |

×

ASSOCIATED COEFFICIENTS

| | | |
|---|---|---|
| 0 | 14 | 4 |
| 0 | 14 | 4 |

Fig. 18C

3RD SUBPIXEL OF 1ST ROW OF OUTPUT IMAGE

SUBPIXEL DATA STORED IN BUFFER MEMORY FOR SIX SUBPIXELS OF INPUT IMAGE

| | | |
|---|---|---|
| 0 | 0 | 0 |
| R13 | R14 | R15 |

×

ASSOCIATED COEFFICIENTS

| | | |
|---|---|---|
| 4 | 14 | 0 |
| 4 | 14 | 0 |

Fig. 18D

4TH SUBPIXEL OF 1ST ROW OF OUTPUT IMAGE

SUBPIXEL DATA STORED IN BUFFER MEMORY FOR SIX SUBPIXELS OF INPUT IMAGE

| | | |
|---|---|---|
| 0 | 0 | 0 |
| R14 | R15 | R16 |

×

ASSOCIATED COEFFICIENTS

| | | |
|---|---|---|
| 0 | 14 | 4 |
| 0 | 14 | 4 |

Fig. 18E

1ST SUBPIXEL OF 2ND ROW OF OUTPUT IMAGE

SUBPIXEL DATA STORED IN BUFFER MEMORY FOR SIX SUBPIXELS OF INPUT IMAGE

| | | |
|---|---|---|
| R11 | R12 | R13 |
| R21 | R22 | R23 |

×

ASSOCIATED COEFFICIENTS

| | | |
|---|---|---|
| 9 | 9 | 0 |
| 9 | 9 | 0 |

Fig. 18F

2ND SUBPIXEL OF 2ND ROW OF OUTPUT IMAGE

SUBPIXEL DATA STORED IN BUFFER MEMORY FOR SIX SUBPIXELS OF INPUT IMAGE

| | | |
|---|---|---|
| R12 | R13 | R14 |
| R22 | R23 | R24 |

×

ASSOCIATED COEFFICIENTS

| | | |
|---|---|---|
| 1 | 16 | 1 |
| 1 | 16 | 1 |

Fig. 18G

3RD SUBPIXEL OF 2ND ROW OF OUTPUT IMAGE

SUBPIXEL DATA STORED IN BUFFER MEMORY FOR SIX SUBPIXELS OF INPUT IMAGE

| | | |
|---|---|---|
| R14 | R15 | R16 |
| R24 | R25 | R26 |

×

ASSOCIATED COEFFICIENTS

| | | |
|---|---|---|
| 9 | 9 | 0 |
| 9 | 9 | 0 |

Fig. 18H

4TH SUBPIXEL OF 2ND ROW OF OUTPUT IMAGE

SUBPIXEL DATA STORED IN BUFFER MEMORY FOR SIX SUBPIXELS OF INPUT IMAGE

| | | |
|---|---|---|
| R15 | R16 | 0 |
| R25 | R26 | 0 |

×

ASSOCIATED COEFFICIENTS

| | | |
|---|---|---|
| 1 | 16 | 1 |
| 1 | 16 | 1 |

DEVICE AND METHOD FOR SUBPIXEL RENDERING

CROSS REFERENCE

This application claims priority to Japanese Patent Application No. 2017-222918, filed on Nov. 20, 2017, the disclosure of which is incorporated herein by reference in its entirety.

BACKGROUND

Field

The present disclosure relates to a device and method for subpixel rendering.

Description of the Related Art

Display panels such as liquid crystal display panels and organic light emitting diode (OLED) display panels are used in electronic appliances such as notebook computers, desktop computers, and smart phones. A display driver for driving a display panel may be configured to perform subpixel rendering (SPR) on an image data of an original image. The SPR is an image data processing to display an image with a resolution higher than the original resolution of the display panel.

SUMMARY

In one or more embodiments, a display driver comprises: subpixel rendering (SPR) circuitry configured to use, in SPR, a plurality of predetermined regions which fall within two lines of input subpixels of an input image; buffer memory circuitry configured to store first subpixel data for a plurality of first subpixels of the input subpixels, wherein the plurality of first subpixels each are encompassed at least partially in the predetermined regions; and a register configured to store coefficients, wherein the coefficients respectively correspond to shapes of portions of the first subpixels encompassed in the predetermined regions. The SPR circuitry is configured to calculate second subpixel data of second subpixels of an output image, based on the first subpixel data stored in the buffer memory circuitry and the coefficients stored in the register.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

FIGS. 18A to 18H illustrate example subpixel data stored in a buffer and example coefficients for SPR, according to one or more embodiments;

DETAILED DESCRIPTION

In the following, a detailed description is given of various embodiments with reference to the drawings. It would be apparent that technologies disclosed herein can be implemented by a person skilled in the art without a further detailed description of these embodiments. For simplicity, details of well-known features are not described in the following.

In one or more embodiments, various subpixel arrangements are used for display panels. SPR circuitry may be adapted to such various subpixel arrangements. When one dedicated circuit is provided for each of subpixel arrangements, for example, the number of circuits may increase up to the number of the subpixel arrangements, and this may enlarge the circuit size. If a new subpixel arrangement is added, a circuit to accommodate the new subpixel arrangement may additionally be integrated, and this may also enlarge the circuit size. A programmable circuit configuration adapted to any types of subpixel arrangements may lead to a huge circuit size. In one or more embodiment, an SPR scheme is designed for various subpixel arrangements without increasing the circuitry size.

Figure 1:
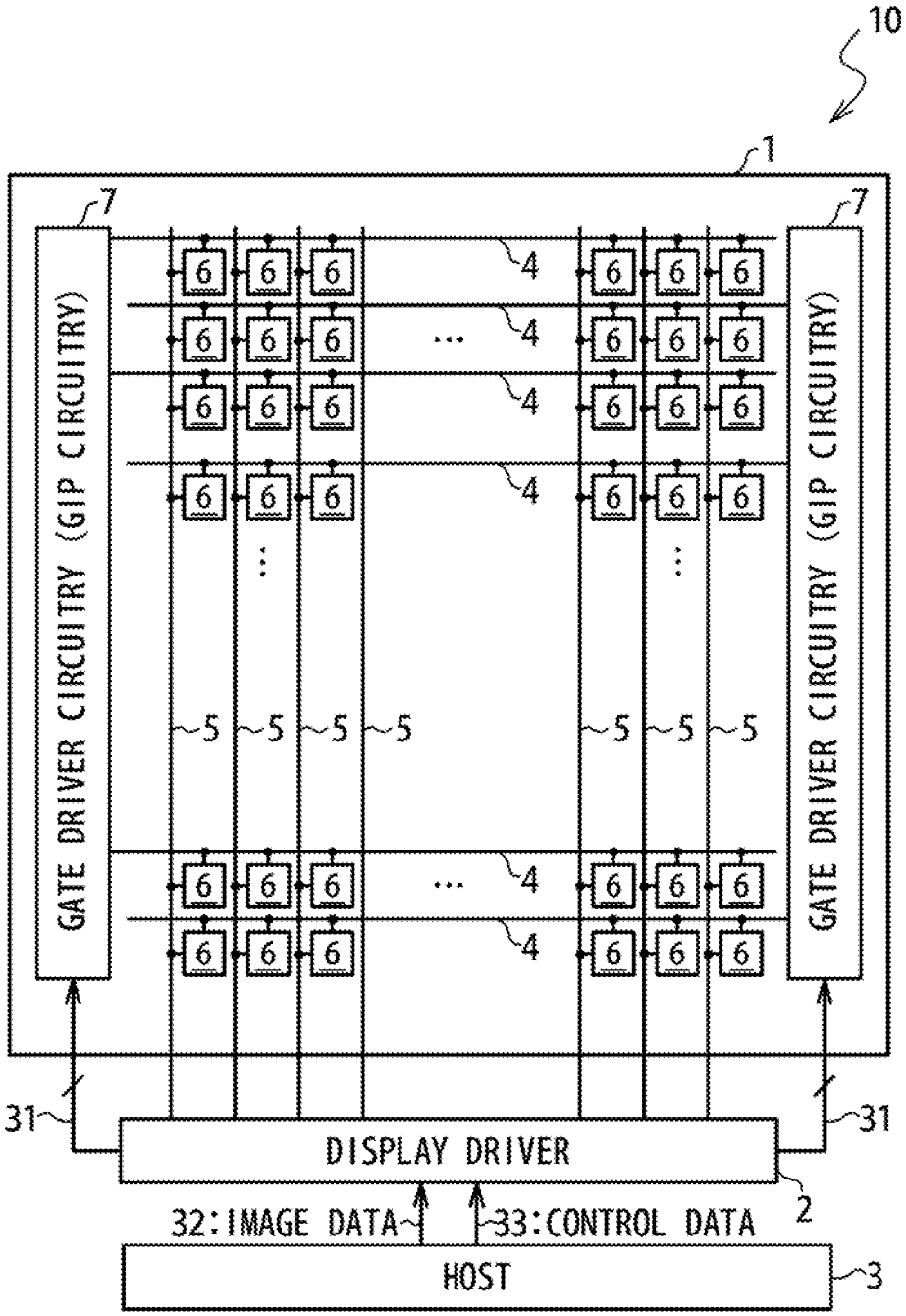
FIG. 1 is a block diagram illustrating an example configuration of a display device, according to one or more embodiments.

FIG. 1 is a block diagram illustrating an example configuration of a display device 10, according to one or more embodiments. The display device 10 comprises a display panel 1 and a display driver 2.

In one or more embodiments, the display device 10 may be configured to provide a user with information on the display panel 1. The display device 10 is one example electronic appliance equipped with a display panel. The electronic appliance may be a portable electronic appliance, such as a smart phone, a laptop computer, a netbook computer, a tablet, a web browser, an electronic book reader, and a personal digital assistant (PDA). The electronic appliance may be a device of any size and shape, such as a desktop computer equipped with a display panel and a display unit mounted on an automobile equipped with a display panel. The electronic appliance may be equipped with a touch sensor for touch sensing of an input object such as a user's finger and stylus.

Examples of the display panel 1 may include an organic light emitting diode (OLED) display panel and a liquid crystal display panel. The display panel 1 comprises gate lines 4, data lines 5, pixel circuits 6 and gate driver circuitries 7.

Each pixel circuit 6, which is disposed at an intersection of a gate line 4 and a data line 5, is configured to display one of red, green and blue. A pixel circuit 6 configured to display red is used as an R subpixel. Similarly, a pixel circuit 6 configured to display green is used as a G subpixel and a pixel circuit 6 configured to display blue is used as a B subpixel. When an OLED display panel is used as the display panel 1, in one or more embodiments, pixel circuits 6 configured to display red, green and blue may include light emitting elements that emit red light, green light and blue light, respectively. In one or more embodiments, the subpixel arrangement of the display panel 1 may be an RGB type or an RGBG type, and subpixels may be disposed at desired positions.

The gate driver circuitry 7 may be configured to drive the gate lines 4 in response to gate control signals 31 received from the display driver 2. In one or more embodiments, a pair of gate driver circuitries 7 are disposed, one of which is configured to drive odd-numbered gate lines 4 and the other is configured to drive even-numbered gate lines 4. In one or more embodiments, the gate driver circuitries 7 are integrated in the display panel 1 with a gate-in-panel (GIP) technology.

The display driver 2 may be configured to drive the display panel 1 in response to image data 32 and control data 33 received from a host 3, to display an image on the display panel 1. The image data 32 describe grayscale values of respective subpixels of respective pixels of an original image, that is, an image to be displayed. The control data 33 may comprise commands and parameters for controlling the display driver 2. Examples of the host 3 may include an application processor, a central processing unit (CPU), and a digital signal processor (DSP).

Figure 2:
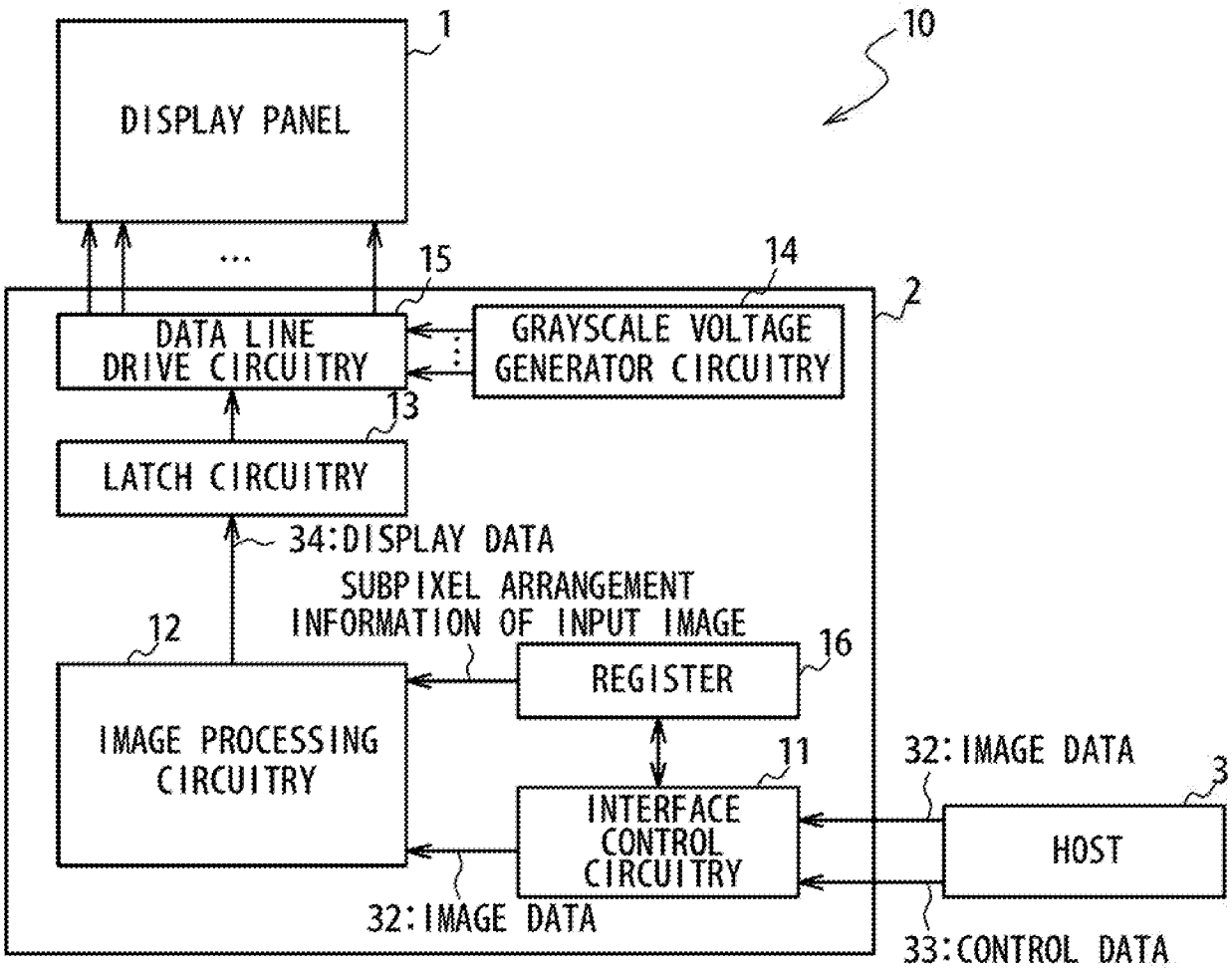
FIG. 2 is a block diagram illustrating an example configuration of a display driver, according to one or more embodiments.

FIG. 2 is a block diagram illustrating an example configuration of the display driver 2, according to one or more embodiments. The display driver 2 comprises interface control circuitry 11, image processing circuitry 12, latch circuitry 13, grayscale voltage generator circuitry 14, data line drive circuitry 15 and a register 16.

In one or more embodiments, the interface control circuitry 11 is configured to transfer the image data 32 received from the host 3 to the image processing circuitry 12. The interface control circuitry 11 may store various control parameters included in the control data 33 into the register 16. The interface control circuitry 11 may control various circuitry integrated in the display driver 2 in response to commands included in the control data 33.

In one or more embodiments, the image processing circuitry 12 is configured to perform desired image data processing on the image data 32 received from the interface control circuitry 11 to generate display data 34 used to drive the display panel 1. The image data processing performed in the image processing circuitry 12 may comprise SPR. The image data processing performed in the image processing circuitry 12 may comprise SPR and various processing (e.g. color adjustment).

In one or more embodiments, the latch circuitry 13 is configured to latch the display data 34 outputted from the image processing circuitry 12 to transfer the same to the data line drive circuitry 15.

In one or more embodiments, the grayscale voltage generator circuitry 14 is configured to generate a set of grayscale voltages respectively corresponding to allowed grayscale values described in the display data 34.

In one or more embodiments, the data line drive circuitry 15 is configured to drive the respective data lines 5 with grayscale voltages corresponding to the grayscale values described in the display data 34. In one or more embodiments, the data line drive circuitry 15 is configured to select grayscale voltages corresponding to the grayscale values described in the display data 34 from among the grayscale voltages supplied from the grayscale voltage generator circuitry 14 and drive the respective data lines 5 to the selected grayscale voltages.

In one or more embodiments, the register 16 is configured to store various parameters used to control the operation of the display driver 2. The register 16 may be configured to be rewritable from outside of the display driver 2, for example, from the host 3. The register 16 may be configured to store for each of display panels having different subpixel arrangements, predetermined coefficients corresponding to shapes of respective portions of subpixels of an input image, the respective portions being encompassed in reference regions. The reference regions are used for SPR, such as reference regions 301 described in later paragraphs. In one or more embodiments, the coefficients are used to multiply subpixel data of subpixels of the input image subjected to the SPR by the image processing circuitry 12.

Figure 3:
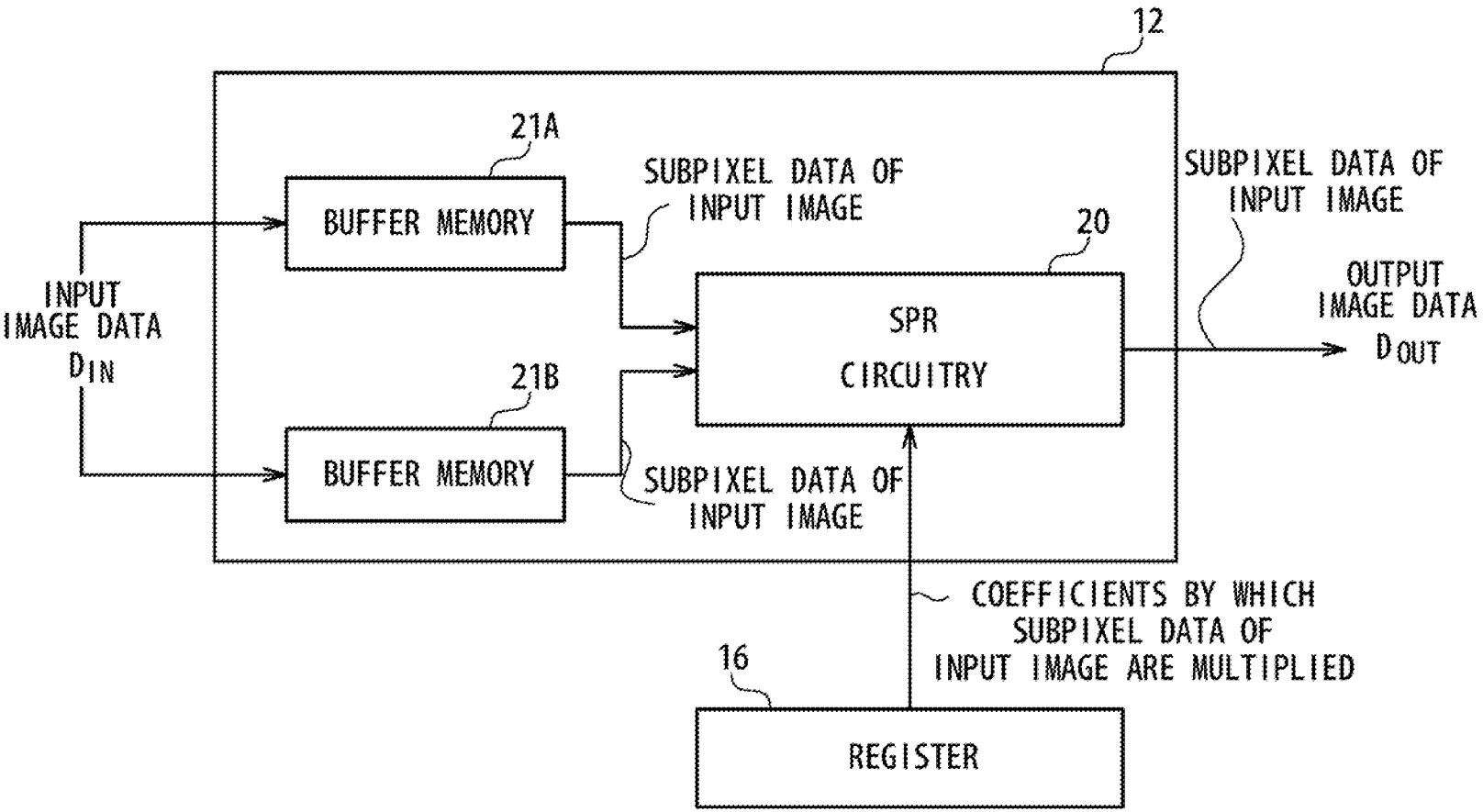
FIG. 3 is a block diagram illustrating an example configuration of image processing circuitry, according to one or more embodiments.

FIG. 3 is a block diagram illustrating an example configuration of the image processing circuitry 12, according to one or more embodiments. In one or more embodiments, the image processing circuitry 12 comprises SPR circuitry 20 and a pair of buffer memories 21A and 21B.

Hereinafter, an image corresponding to input image data $D_{IN}$ may be referred to as an input image, and an image corresponding to output image data $D_{OUT}$ may be referred to as an output image. In one or more embodiments, the input image data $D_{IN}$ describe the grayscale values of respective subpixels (including R subpixels, G subpixels and B subpixels) of respective pixels of the input image. In one or more embodiments, the output image data $D_{OUT}$ describe the grayscale values of respective subpixels of respective pixels of the output image.

The input image data $D_{IN}$ inputted to the image processing circuitry 12 may comprise the image data 32 supplied to the image processing circuitry 12 from the interface control circuitry 11. Image data obtained by performing desired image data processing on the image data 32 may be used as the input image data $D_{IN}$. The output image data $D_{OUT}$ outputted from the image processing circuitry 12 may be used as the display data 34 supplied to the data line drive circuitry 15. Image data obtained by performing desired image data processing on the output image data $D_{OUT}$ may be supplied to the data line drive circuitry 15 as the display data 34.

In one or more embodiments, each of the pair of buffer memories 21A and 21B comprises a buffer for a plurality of subpixels. Each of the buffer memories 21A and 21B may be configured to store subpixel data for six subpixels included in the input image data $D_{IN}$ inputted thereto and output the same to the SPR circuitry 20. The number of subpixels which each of the buffer memories 21A and 21B store may not be limited to six and may be any allowed number of subpixels of the input image encompassed in the reference regions 301. In one or more embodiments, after outputting the stored subpixel data for six subpixels, each of the buffer memories 21A and 21B receives subpixel data for next six subpixels of the input image and stores the subpixel data for the next six subpixels. In one or more embodiments, this process is repeated until SPR for the entire input image is completed.

In one or more embodiments, the SPR circuitry 20 is configured to perform predetermined processing for SPR on the subpixel data of the input image outputted from the buffer memories 21A and 21B. For example, the SPR circuitry 20 is configured to read out coefficients assigned to six subpixels of the input image from the register 16. In one or more embodiments, the coefficients are determined based on the subpixel arrangement of the display panel 1. In one or more embodiments, the SPR circuitry 20 is further configured to multiply the subpixel data of the respective subpixels of the input image by the coefficients, to calculate subpixel data of the respective subpixels of the output image. Since the coefficients are selectively determined based on the subpixel arrangement of the display panel 1, the SPR can be achieved without modifying the circuit configuration of the display driver 2 for various subpixel arrangements of the display panel 1. In one or more embodiments, the SPR circuitry 20 is configured to perform SPR so that the total number of the subpixels of the output image becomes two thirds of that of the subpixels of the input image.

In one or more embodiments, SPR is performed based on a region 301 which falls within two subpixel lines of the input image. This region may be referred to as the "reference region." In one or more embodiments, six subpixels for which each of the buffer memories 21A and 21B stores subpixel data are encompassed in the two subpixel lines in the input image. A "line" referred to herein may mean a row of subpixels arrayed in the horizontal direction of the image. The direction perpendicular to the horizontal direction is referred to as the vertical direction.

In one or more embodiments, two types of SPR may be used: one is an RGB type and the other an RGBG type. In one or more embodiments, the RGB type SPR is designed to, when performed on input image data of an input image, generate output image data of an output image in which the numbers of R, G and B subpixels are reduced down to ⅔ of those of the input image, respectively, and thereby the total number of subpixels of the output image is also reduced down to ⅔. In one or more embodiments, the RGBG type SPR is designed to, when performed on input image data of an input image, generate output image data of an output image in which the numbers of R and B subpixels are reduced down to ½ of those of the input image, respectively, with the number of G subpixels unchanged. This also results in that the total number of subpixels of the output image is reduced down to ⅔.

In one or more embodiments, the SPR circuitry 20 is configured to perform SPR on the subpixels of the input image so that the total number of the subpixels of the output image corresponding to the output image data $D_{OUT}$ is ⅔ of that of the subpixels of the input image corresponding to the input image data $D_{IN}$.

In one or more embodiments, SPR is performed on subpixel data of subpixels encompassed in two lines of subpixels arrayed in the horizontal direction in an input image to calculate subpixel data of respective subpixels of an output image.

Figure 4:
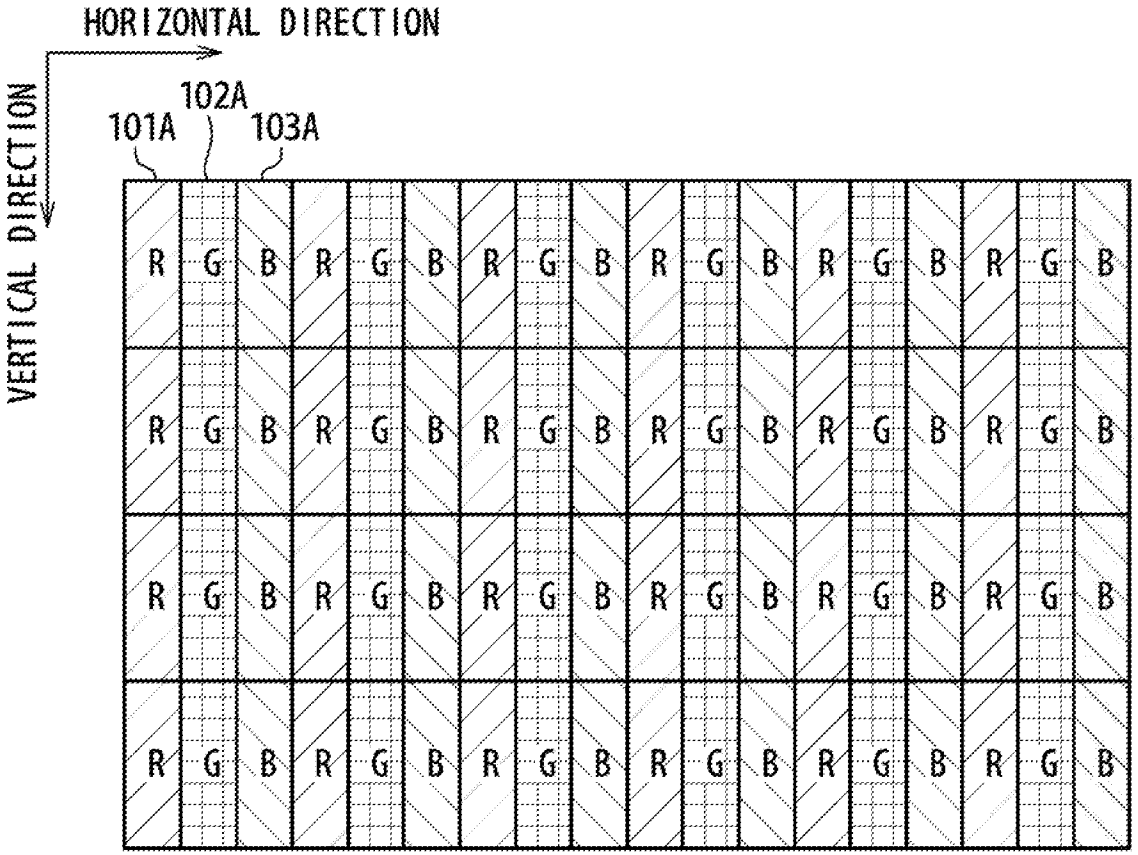
FIG. 4 illustrates an example subpixel arrangement of an input image, according to one or more embodiments.
Figure 5:
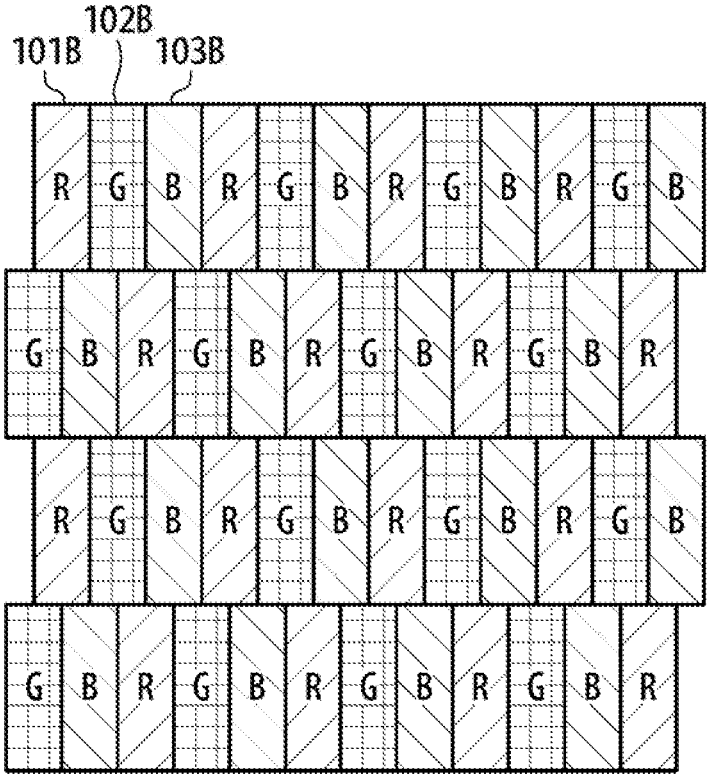
FIG. 5 illustrates an example subpixel arrangement of an output image to be obtained by SPR, according to one or more embodiments.

In the SPR, in one or more embodiments, the subpixel arrangement of the input image illustrated in FIG. 4 is mapped to the subpixel arrangement of the RGB type of the to-be-obtained output image as illustrated in FIG. 5. As illustrated in FIG. 4, R subpixels 101A, G subpixels 102A, and B subpixels 103A are arrayed in series in the horizontal direction in the input image. The arrays, each comprising an R subpixel 101A, a G subpixel 102A, and a B subpixel 103A, are repeatedly arranged in the horizontal direction. As illustrated in FIG. 4, the R subpixels 101A, the G subpixels 102A, and the B subpixels 103A are successively arranged in the vertical direction. In the example of the subpixel arrangement illustrated in FIG. 5, R subpixels 101B, G subpixels 102B, and B subpixels 103B are arrayed in the horizontal direction in this order and, the arrays, each comprising an R subpixel 101B, a G subpixel 102B, and a B subpixel 103B, are repeatedly arranged in the horizontal direction. The numbers of the R subpixels 101B, the G subpixels 102B and the B subpixels 103B after the SPR illustrated in FIG. 5 are ⅔ of those of the R subpixels 101A, the G subpixels 102A and the B subpixels 103A illustrated in FIG. 4. In one or more embodiments, the subpixel arrangement may be variously modified, not limited to the example illustrated in FIG. 5; subpixels may be positioned as desired.

Figure 6:
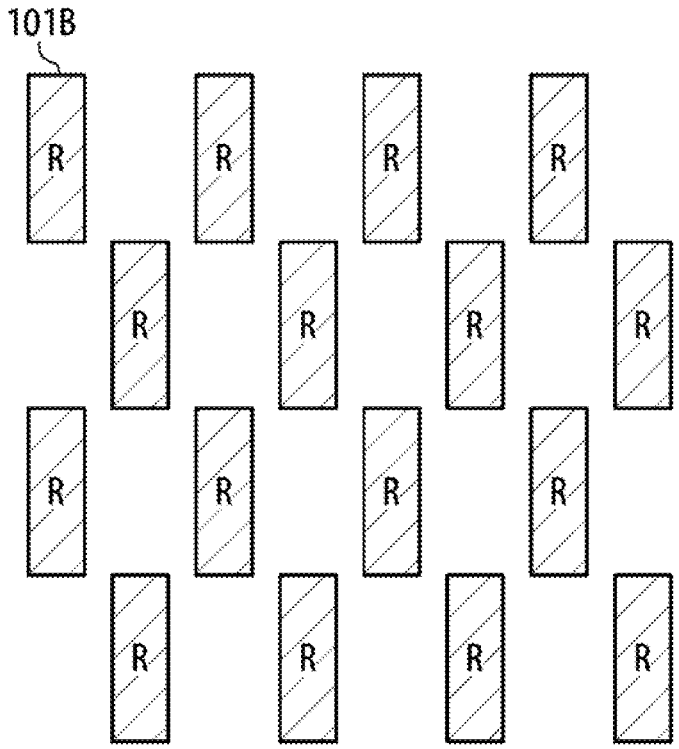
FIG. 6 illustrates example R subpixels of the to-be-obtained output image, according to one or more embodiment.

In the following, a description is given with respect to R subpixels for simplicity. FIG. 6 selectively illustrates R subpixels 101B in the subpixel arrangement of the to-be-obtained output image illustrated in FIG. 5.

Figure 7:
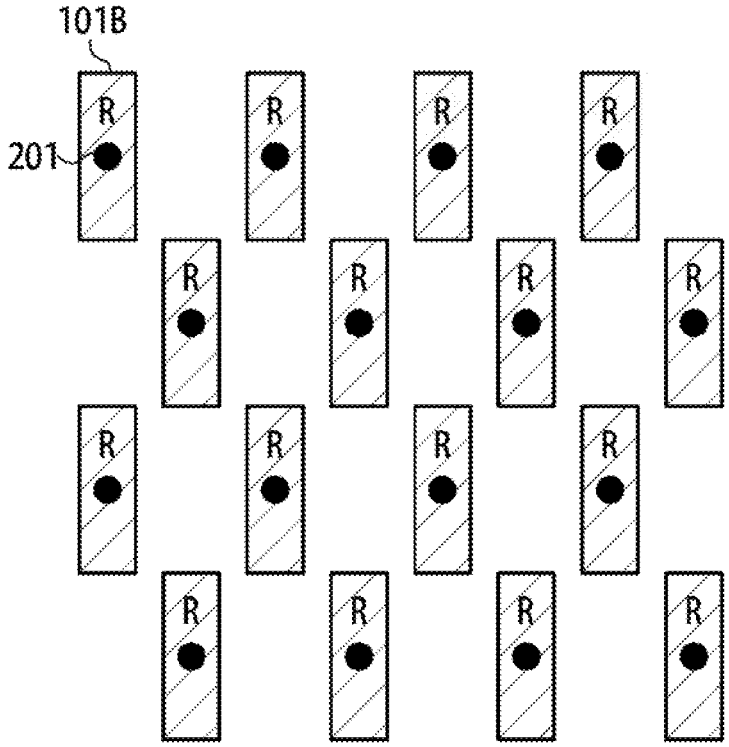
FIG. 7 illustrates the R subpixels superposed with example geometric centers thereof, according to one or more embodiments.
Figure 8:
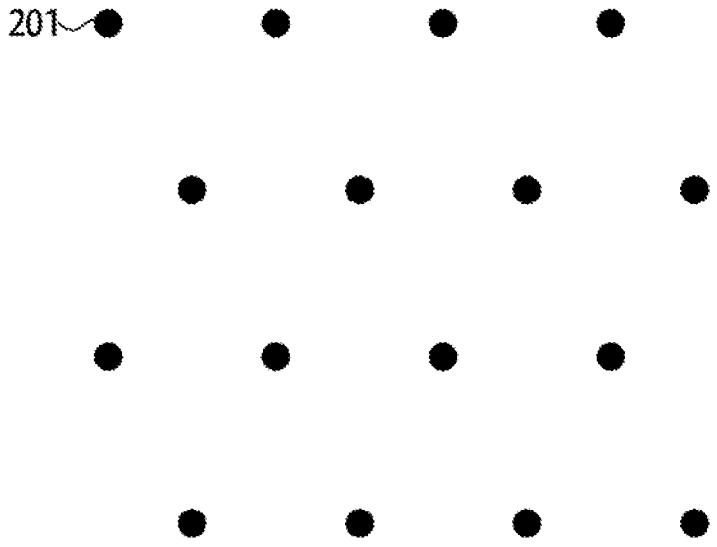
FIG. 8 illustrates the geometric centers of the R subpixels, according to one or more embodiments.

In one or more embodiments, geometric centers of the R subpixels 101B are first calculated with respect to the output image to be obtained through the SPR. Illustrated in FIG. 7 are the geometric centers 201 of the R subpixels 101B calculated based on the positions of the R subpixels 101B, according to one or more embodiments. FIG. 8 selectively illustrates the calculated geometric centers 201 of the R subpixels 101B, according to one or more embodiments.

Figure 9:
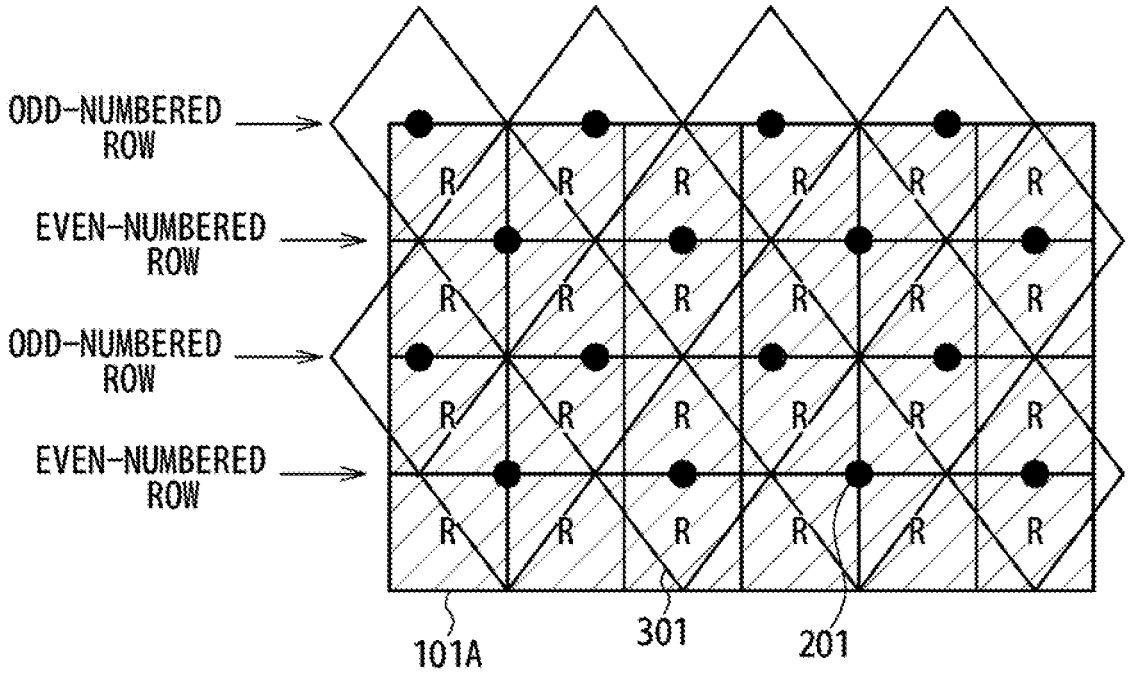
FIG. 9 illustrates example regions of R subpixels of the input image associated with the geometric centers of the R subpixels of the to-be-obtained output image, according to one or more embodiments.

In one or more embodiments, as illustrated in FIG. 9, the geometric centers 201 of the R subpixels 101B of the to-be-obtained output image are superposed on the subpixels 101A of the input image, and a reference region 301 associated with each geometric center 201 is defined in the input image so that the reference region 301 falls within two subpixel lines of the input image. The reference region 301 is a predetermined region defined in R subpixels 101A of the input image. The reference region 301 is used in calculating a subpixel data of an R subpixel 101B of the output image in the SPR. Limiting the reference region of the input image to be used in the SPR in such a way may reduce the circuit size of the display driver 2.

In the example illustrated in FIG. 9, two reference patterns repeat in each row of the reference regions 301. For example, the reference regions 301 are repeatedly arranged in units of two subpixels in each odd-numbered row and each even-numbered row of the reference regions 301. In one or more embodiments, the reference regions 301 defined in the input image are classified into four reference patterns 3011 to 3014 illustrated in FIG. 10, depending on the shapes of the portions of the R subpixels 101A encompassed in the reference regions 301. For example, the geometric center of an R subpixel 101B may be associated with a portion A of a first R subpixel 101A, a portion B of a second R subpixel 101A, a portion C of a third R subpixel 101A, and a portion D of a fourth R subpixel 101A in accordance with the reference pattern 3011 illustrated in FIG. 10. Similarly, the portions E to H, I to L and N to R of R subpixels 101A may be associated with geometric centers 201 in accordance with the reference patterns 3012, 3013 and 3014 illustrated in FIG. 10, respectively. The areas of the portions A to R of R subpixels 101A may be represented with normalized values. The areas of the portions A to R may be represented as coefficients by which subpixel data of R subpixels 101A of the input image are multiplied to calculate subpixel data of R subpixels 101B of the output image.

In one or more embodiments, as illustrated in FIG. 9, the reference pattern 3011 is applied to reference regions 301 defined for odd-numbered subpixels in odd-numbered rows. In one or more embodiments, the reference pattern 3012 is applied to reference regions 301 defined for even-numbered subpixels in odd-numbered rows. In one or more embodiments, the reference pattern 3013 is applied to reference regions 301 defined for odd-numbered subpixels in even-numbered rows. In one or more embodiments, the reference pattern 3014 is applied to reference regions 301 defined for even-numbered subpixels in even-numbered rows. As thus described, in one or more embodiments, the reference regions 301 in each row have two different patterns alternately repeated in the horizontal direction and determined based on the shapes of the portions of the R subpixels 101A encompassed in the reference regions 301.

In one or more embodiments, the reference regions 301 are defined so as to satisfy first to third conditions described in the following.

(First Condition)

Figure 10:
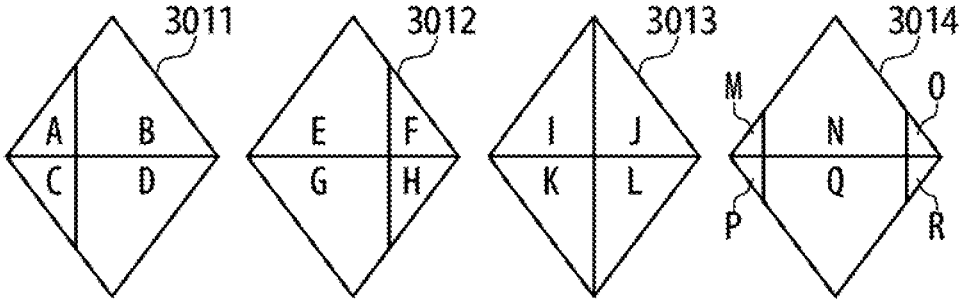
FIGS. 10 to 12 illustrate example conditions of coefficients for SPR with respect to the R subpixels, according to one or more embodiments.

To maintain brightness balance of the input image after SPR, in one or more embodiments, the sum of the areas of the portions of the R subpixels 101A encompassed in each reference region 301 is constant. For example, the totals of the coefficients assigned to the portions A to D, E to H, I to L and M to R encompassed in the respective reference patterns 3011 to 3014 are made equal to each other. In one or more embodiments, as illustrated in FIG. 10, the coefficients A to R assigned to the respective portions of the subpixels 101A of the respective reference patterns 3011 to 3014 may be determined so that the first condition is satisfied, in which:

$$A+B+C+D=E+F+G+H=I+J+K+L=M+N+O+P+Q+R.$$

(Second Condition)

Figure 11:
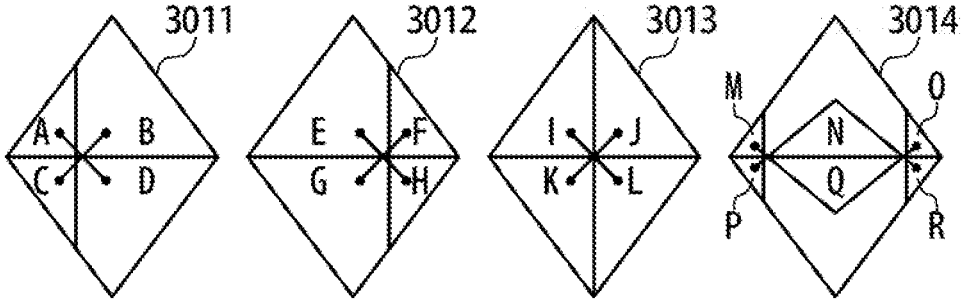

To prevent distortion in an output image obtained through the SPR in the case when the input image is in a special pattern such as a checker pattern, in one or more embodiment, the sum of the areas of two portions of the R subpixels 101A diagonally arranged in each reference region 301 is constant. For example, the total of the coefficients assigned to every two of the portions diagonally arranged in each reference region 301 is constant with respect to the respective reference patterns 3011 to 3014. In one or more embodiments, as illustrated in FIG. 11, the coefficients A to R assigned to the respective portions of the R subpixels 101A of the respective reference patterns 3011 to 3014 may be determined so that the second condition is satisfied, in which:

$$A+D=B+C=E+H=F+G=I+L=J+K=M+Q+O=P+N+R.$$

(Third Condition)

Figure 12:
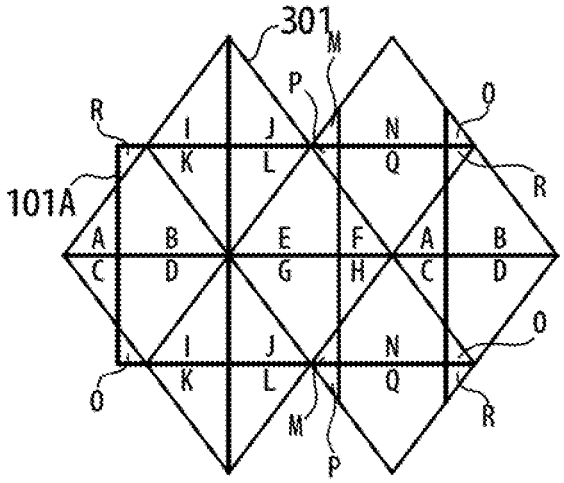

When a screen image is moved by a manual operation such as scrolling, reference regions 301 adjacent vertically and horizontally vary, and this may cause flickering of small characters. In one or more embodiments, to prevent such flickering of characters in screen scrolling, the area of each R subpixel 101A in the input image is constant. In one or more embodiments, the total of the coefficients assigned to the portions encompassed in each R subpixel 101A is constant. For example, as illustrated in FIG. 12, the coefficients assigned to the respective portions of each R subpixel 101A may be determined so that the third condition is satisfied, in which:

$$B+K+R=E+L+P=A+F+Q=D+I+O=G+J+M=C+H+N.$$

Figure 13:
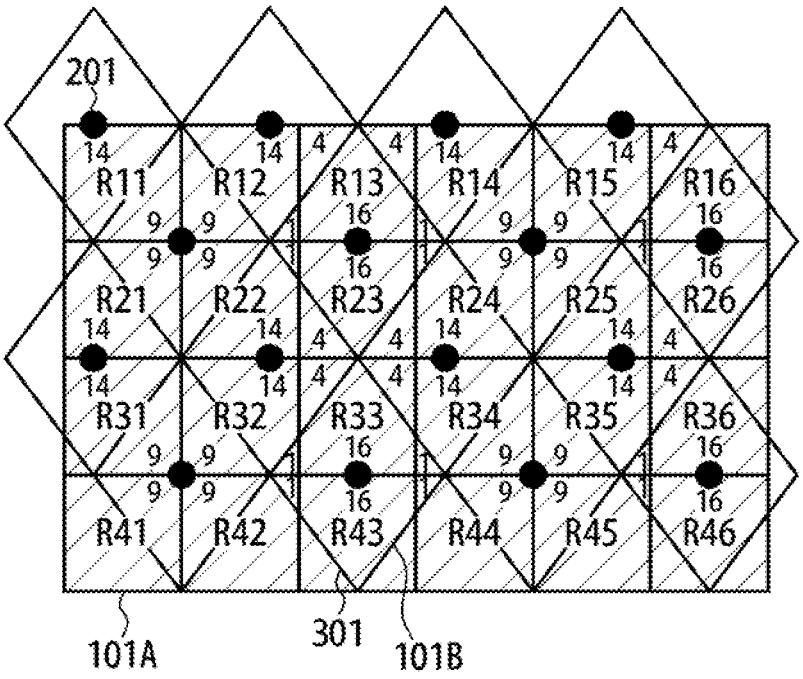
FIGS. 13 and 14 illustrate example coefficients for SPR with respect to the R subpixels, according to one or more embodiments.

Illustrated in FIG. 13 are example coefficients A to R which satisfy the above-described first to third conditions. In one or more embodiments, as illustrated in FIG. 13, the total of the coefficients assigned to the portions encompassed in each reference region 301 is set to 36 to satisfy the first condition. In one or more embodiments, the total of the coefficients assigned to every two diagonally-arranged portions in each reference region 301 is set to 18 to satisfy the second condition. In one or more embodiments, the total of the coefficients assigned to the portions of each R subpixel 101A is set to 18 to satisfy the third condition. In one or more embodiments, the SPR circuitry 20 is configured to perform processing on the subpixel data of the R subpixels 101A outputted from the buffer memories 21A and 21B, using the coefficients stored in the register 16, which are illustrated in FIG. 13.

Referring to FIG. 13, a description is given of an example in which a subpixel data of an odd-numbered R subpixel 101B from the left in an odd-numbered row of the R subpixels 101B after the subpixel rendering is calculated through SPR. In one or more embodiments, the subpixel data $R_{spr}(3, 3)$ of the third subpixel 101B in the third row is calculated through SPR in accordance with the following expression:

$$R_{spr}(3, 3) = \sqrt[\gamma]{\frac{4R_{23}^{\gamma} + 14R_{24}^{\gamma} + 4R_{33}^{\gamma} + 14R_{34}^{\gamma}}{36}},$$

where $R_{23}$, $R_{24}$, $R_{33}$ and $R_{44}$ in this expression are the subpixel data of the subpixels R23, R24, R33 and R34, respectively, which are selected from the R subpixels 101A of the input image as illustrated in FIG. 13.

In one or more embodiments, to display an image with desired brightness in conformity to the gamma property of the display panel 1, the subpixel data $R_{spr}(3, 3)$ is obtained as the $(1/\gamma)$-th power of the weighted sum of the $\gamma$-th power of subpixel data of the relevant subpixels 101A of the input image in accordance with the above-presented expression, where $\gamma$ is the gamma value.

Described below is another example in which a subpixel data of an even-numbered R subpixel 101B from the left in an odd-numbered row of the R subpixels 101B is similarly calculated. In one or more embodiments, the subpixel data $R_{spr}(3, 4)$ of the third subpixel 101B in the third row is calculated through SPR in accordance with the following expression:

$$R_{spr}(3, 4) = \sqrt[\gamma]{\frac{14R_{25}^{\gamma} + 4R_{26}^{\gamma} + 14R_{35}^{\gamma} + 4R_{36}^{\gamma}}{36}}.$$

Described below is still another example in which a subpixel data of an odd-numbered R subpixel 101B from the left in an even-numbered row of the R subpixels 101B is similarly calculated. In one or more embodiments, the subpixel data $R_{spr}(2, 1)$ of the first subpixel 101B in the second row is calculated through SPR in accordance with the following expression:

$$R_{spr}(2, 1) = \sqrt[\gamma]{\frac{9R_{11}^{\gamma} + 9R_{12}^{\gamma} + 9R_{21}^{\gamma} + 9R_{22}^{\gamma}}{36}}.$$

Described below is still another example in which a subpixel data of an even-numbered R subpixel 101B from the left in an even-numbered row of the R subpixels 101B is similarly calculated. In one or more embodiments, the subpixel data $R_{spr}(2, 2)$ of the second subpixel 101B in the second row is calculated through SPR in accordance with the following expression:

$$R_{spr}(2, 2) = \sqrt[\gamma]{\frac{R_{12}^{\gamma} + 16R_{13}^{\gamma} + R_{14}^{\gamma} + R_{22}^{\gamma} + 16R_{23}^{\gamma} + R_{24}^{\gamma}}{36}}.$$

In one or more embodiments, in the subpixel arrangement illustrated in FIG. 13, there are portions of R subpixels 101A of the input image, the portions being not encompassed in the reference regions 301. In an example illustrated in FIG. 14, according to one or more embodiments, portions of the R subpixels 101A in which the start points of the arrows are positioned are not encompassed in any reference regions 301. When the portions of the R subpixels 101A which are not encompassed in any reference regions 301 are not used in the SPR, an image obtained by performing SPR on an input image which includes white lines at the horizontal and vertical edges may fail to include white lines when displayed on the display panel 1; this may cause a color shift. In one or more embodiments, the portions of the R subpixels 101A in which the start points of the arrows are positioned are used in SPR.

Figure 14:
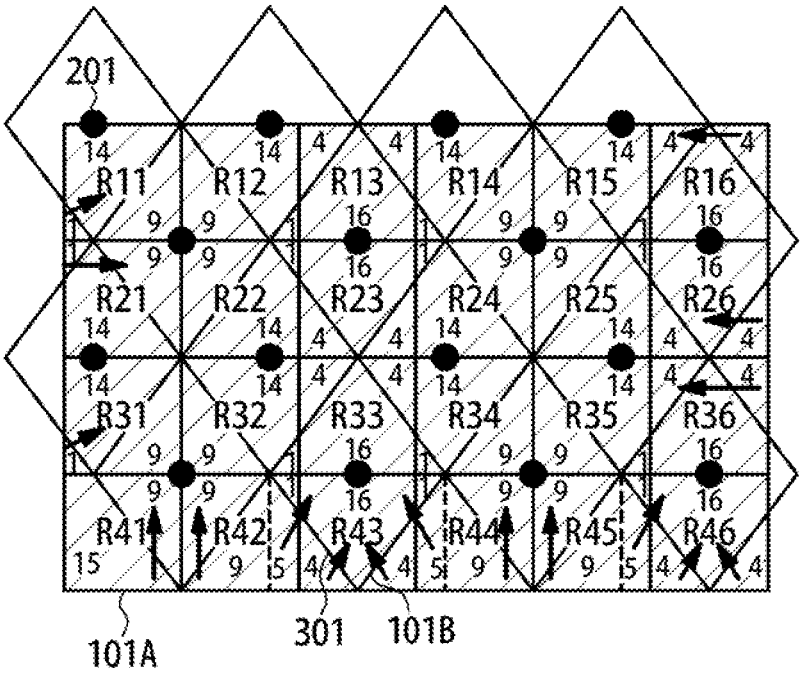

With respect to the example illustrated in FIG. 14, when portions of R subpixels 101A which are not encompassed in any reference regions 301 are not used in SPR, the subpixel data $R_{spr}(4, 2)$ of the second subpixel 101B in the fourth row may be calculated through SPR in accordance with the following expression:

$$R_{spr}(4, 2) = \sqrt[\gamma]{\frac{R_{32}^{\gamma} + 16R_{33}^{\gamma} + R_{34}^{\gamma} + R_{42}^{\gamma} + 16R_{43}^{\gamma} + R_{44}^{\gamma}}{36}}.$$

For the same example illustrated in FIG. 14, when portions of R subpixels 101A which are not encompassed in any reference regions 301 are used in SPR, in one or more embodiments, the subpixel data $R_{spr}(4, 2)$ of the second subpixel 101B in the fourth row may be calculated through SPR in accordance with the following expression:

$$R_{spr}(4, 2) = \sqrt[\gamma]{\frac{R_{32}^{\gamma} + 16R_{33}^{\gamma} + R_{34}^{\gamma} + (1+5)\ R_{42}^{\gamma} + (16+4+4)\ R_{43}^{\gamma} + (1+5)\ R_{44}^{\gamma}}{36}}.$$

As is understood from this expression, a value of "5" may be added to the coefficient associated with the R subpixel R42 of the input image. Similarly, values of "4" and "4" may be added to the coefficient associated with the R subpixel R43 of the input image, and a value of "5" may be added to the coefficient associated with the R subpixel R44 of the input image. In one or more embodiments, SPR may be similarly performed for R subpixels 101A which are not encompassed in the reference regions 301 positioned at the edge of the input image. When the grayscale value of a subpixel is represented by eight bits in the subpixel data, the result of the SPR may be clipped so that the result of the SPR does not exceed "255."

A description is then given of reference regions defined in the input image which are used in SPR for G subpixels and B subpixels, in one or more embodiments. In one or more embodiments, as illustrated in FIG. 4, a G subpixel 102A is positioned rightward in the horizontal direction with respect to a corresponding R subpixel 101A and a B subpixel 103A is positioned rightward with respect to a corresponding G subpixel 102A.

Figure 15:
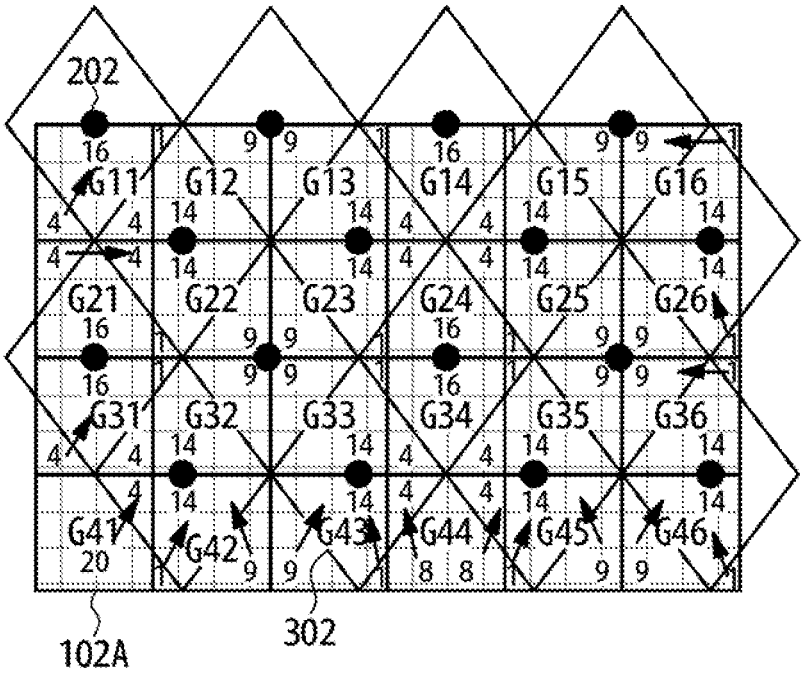
FIG. 15 illustrates example coefficients for SPR with respect to G subpixels, according to one or more embodiments.

Accordingly, as illustrated in FIG. 15, the geometric center 202 of a G subpixel 102B of the output image is positioned rightward with respect to the geometric center 201 of a corresponding B subpixel 101B. In one or more embodiments, a reference region 302 associated with each geometric center 202 is defined in the input image so that the reference region 302 is falls within two lines of the G subpixels 102A. The procedure of the SPR for the R subpixels, which is described with reference to FIGS. 6 to 14, is also applied to SPR for the G subpixels. In the SPR for calculating the subpixel data of a G subpixel of the output image, subpixel data of the G subpixels 102A, portions of which are included in the associated reference region 302, are multiplied by the coefficients assigned to the G subpixels 102A.

Figure 16:
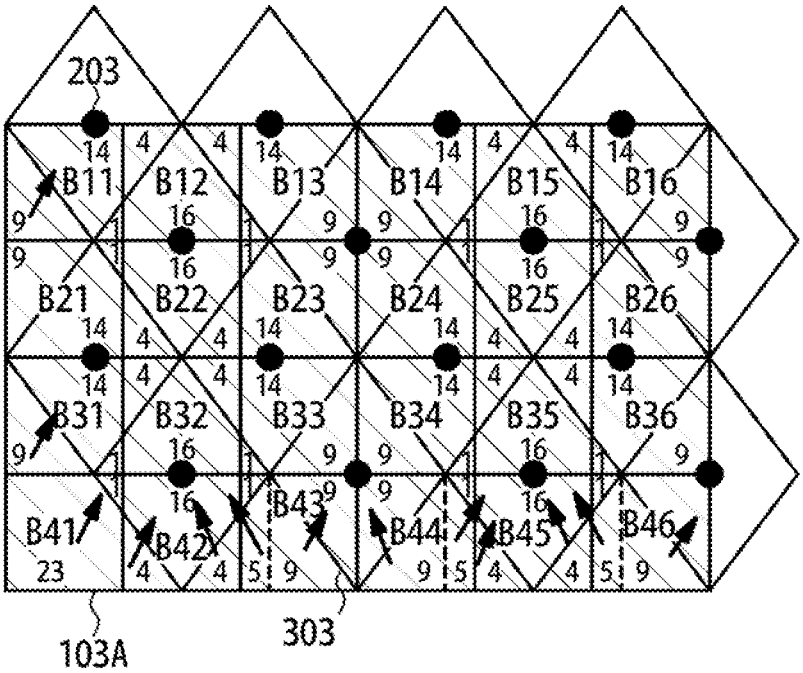
FIG. 16 illustrates example coefficients for SPR with respect to B subpixels, according to one or more embodiments.

Similarly, as illustrated in FIG. 16, the geometric center 203 of a B subpixel 103B of the output image are positioned rightward with respect to the geometric center 202 of a corresponding G subpixel 101G. In one or more embodiments, a reference region 303 associated with each geometric center 203 is defined in the input image so that the reference region 303 is falls within two lines of the B subpixels 103A. The procedure of the SPR for the R subpixels, which is described with reference to FIGS. 6 to 14, is also applied to the SPR for the B subpixels. In the SPR for calculating the subpixel data of a B subpixel of the output image, subpixel data of the B subpixels 103A, portions of which are included in the associated reference region 303, are multiplied by the coefficients assigned to the B subpixels 103A.

A description is then given of example configurations of the buffer memories 21A and 21B and example processing performed by the SPR circuitry 20. In one or more embodiments, as illustrated in FIG. 9, the maximum number of subpixels of the input image used in the SPR with respect to a subpixel of the output image is six. Furthermore, as described above, the patterns of the reference regions 301 to 303 repeat with a cycle of two subpixels in each of the odd-numbered rows and the even-numbered rows in one or more embodiments. Accordingly, in one or more embodiments, a pair of buffer memories 21A and 21B are provided, which each are configured to store subpixel data for six subpixels of the input image. In one or more embodiments, the SPR is performed by using coefficients respectively assigned to six subpixels of the input image.

Figure 17A:
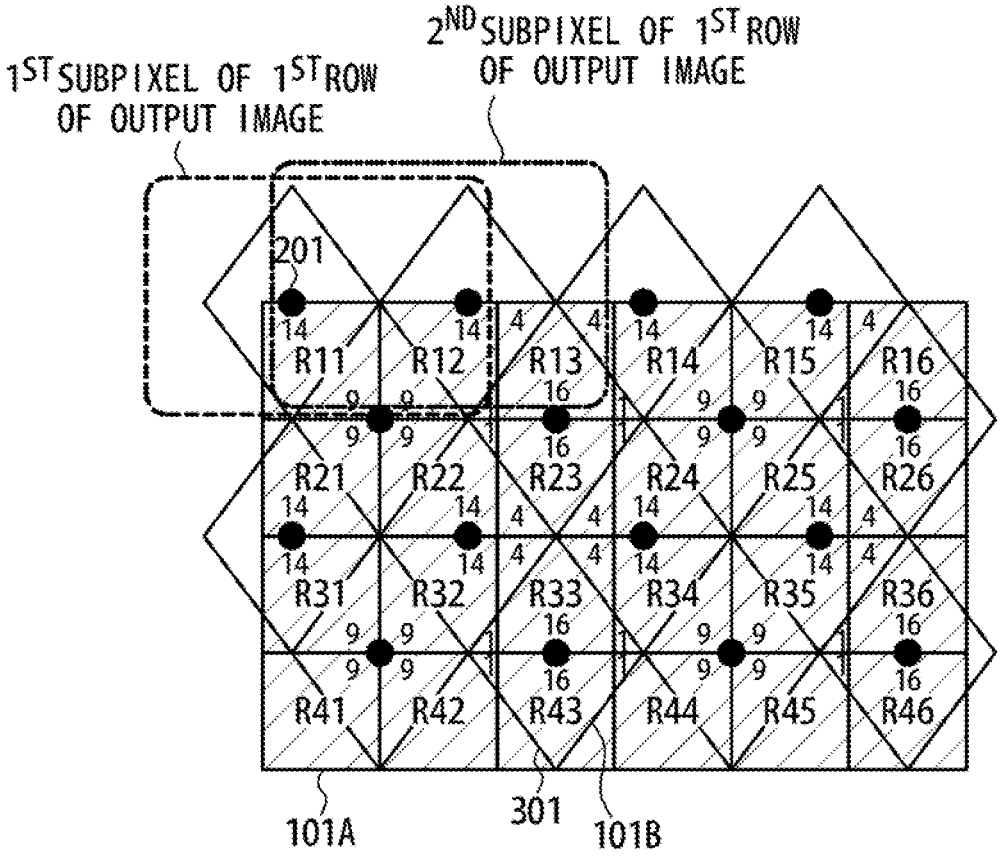
FIGS. 17A and 17B illustrate relationships between subpixels of the to-be-obtained output image of an RGB type subpixel arrangement and subpixel data of subpixels of the input image stored in a buffer, according to one or more embodiments.

In one or more embodiments, when the subpixel data for the first R subpixel of the first row of the output image is calculated, for example, the six subpixels of the input image encompassed in the region indicated by the broken line illustrated in FIG. 17A are used. In one or more embodiments, as illustrated in FIG. 18A, a first one of the buffer memories 21A and 21B, for example, the buffer memory 21A, stores subpixel data of "0", "0" and "0", as indicated in the top row from the left, and subpixel data of "0", "R11" and "R12" as indicated in the bottom row from the left, so that the subpixel data are associated with the positions of the six relevant subpixels encompassed in the region of the input image indicated by the broken line illustrated in FIG. 17A. The subpixel data of "0" illustrated in FIG. 18A may imply that there are no corresponding subpixels to be used in the input image. In one or more embodiments, as illustrated in FIG. 18A, the coefficients assigned to the six relevant subpixels of the input image are "4", "14" and "0", as indicated in the top row from the left, and "4", "14" and "0", as indicated in the bottom row from the left.

Similarly, in one or more embodiments, when the subpixel data for the second R subpixel of the first row of the output image is calculated, the six subpixels of the input image encompassed in the region indicated by the long dashed short dashed line illustrated in FIG. 17A are used. In one or more embodiments, as illustrated in FIG. 18B, a second one of the buffer memories 21A and 21B, for example, the buffer memory 21B, stores subpixel data of "0", "0" and "0", as indicated in the top row from the left, and subpixel data of "R11", "R12", "R13", as indicated in the bottom row from the left, so that the subpixel data are associated with the positions of the six relevant subpixels encompassed in the region of the input image indicated by the long dashed short dashed line illustrated in FIG. 17A. In one or more embodiments, as illustrated in FIG. 18B, the coefficients assigned to the six relevant pixels of the input image are "0", "14" and "4", as indicated in the top row from the left, and "0", "14" and "4", as indicated in the bottom row from the left.

Figure 17B:
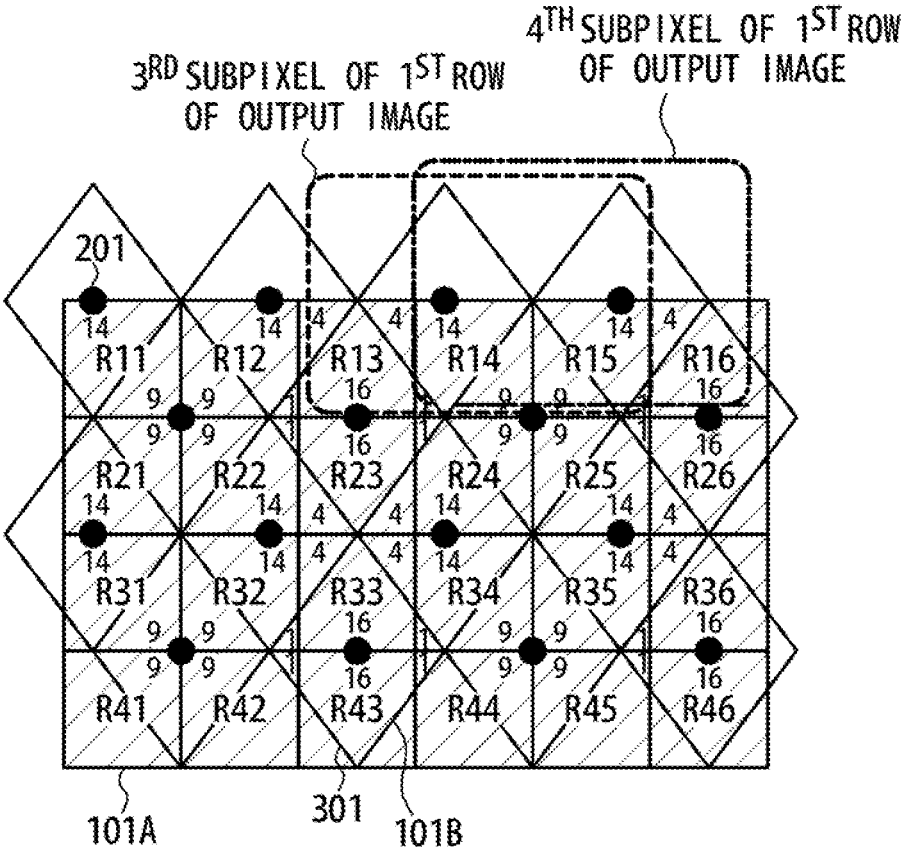

In one or more embodiments, when the subpixel data for the third R subpixel of the first row of the output image is calculated, the six subpixels of the input image encompassed in the region indicated by the broken line illustrated in FIG. 17B are used. In one or more embodiments, as illustrated in FIG. 18C, the first one of the buffer memories 21A and 21B stores subpixel data of "0", "0" and "0", as indicated in the top row from the left, and subpixel data of "R13", "R14" and "R15" as indicated in the bottom row from the left, so that the subpixel data are associated with the positions of the six relevant subpixels encompassed in the region of the input image indicated by the broken line illustrated in FIG. 17B. The subpixel data of "0" illustrated in FIG. 18C imply that there are no corresponding subpixels to be used in the input image. In one or more embodiments, as illustrated in FIG. 18C, the coefficients assigned to the six relevant pixels of the input image are "4", "14" and "0", as indicated in the top row from the left, and "4", "14" and "0", as indicated in the bottom row from the left.

When the subpixel data for the fourth R subpixel of the first row of the output image is calculated, the six subpixels of the input image encompassed in the region indicated by the long dashed short dashed line illustrated in FIG. 17B are used. In one or more embodiments, as illustrated in FIG. 18D, the second one of the buffer memories 21A and 21B stores subpixel data of "0", "0" and "0", as indicated in the top row from the left, and subpixel data of "R14", "R15", "R16", as indicated in the bottom row from the left, so that the subpixel data are associated with the positions of the six relevant subpixels encompassed in the region of the input image indicated by the long dashed short dashed line illustrated in FIG. 17B. In one or more embodiments, as illustrated in FIG. 18D, the coefficients assigned to the six relevant pixels of the input image are "0", "14" and "4", as indicated in the top row from the left, and "0", "14" and "4", as indicated in the bottom row from the left.

FIGS. 18E to 18H illustrate subpixel data of six relevant subpixels of the input image stored in buffer memories 21A and 21B, and the coefficients assigned to the six relevant subpixels in the SPR for the first to fourth R subpixels of the second row of the output image, respectively, for the example illustrated in FIG. 13.

Figure 19A:
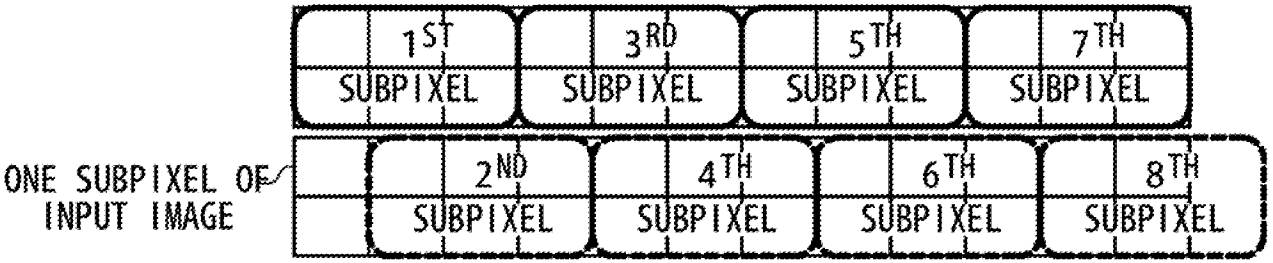
FIGS. 19A and 19B illustrate an example of inputting coefficients into a buffer for an RGB type subpixel arrangement, according to one or more embodiments.
Figure 19B:
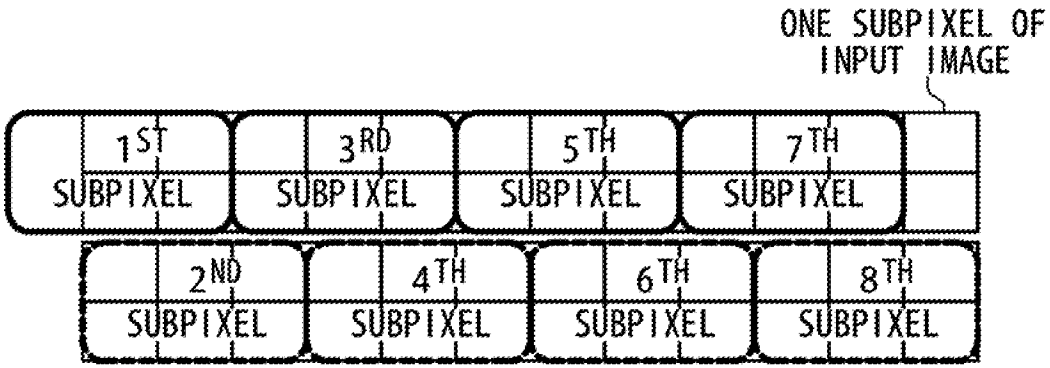

FIGS. 19A and 19B respectively illustrate, for an RGB type subpixel arrangement, the relationship between six subpixels of the input image which are used in calculating the subpixel data of each of subpixels in the even-numbered rows and the odd-numbered rows of the output image, and coefficients respectively assigned to the six subpixels, according to one or more embodiments. FIGS. 19A and 19B schematically illustrate subpixels of the input image which are used in calculating subpixel data of the first to eighth subpixels of each row of the output image, according to one or more embodiments. Although FIGS. 19A and 19B illustrate the relationship between the subpixels of the input image and the coefficients for first to eighth subpixels of the output image, in one or more embodiments, the regularity illustrated in FIGS. 19A and 19B are applied to the ninth and other subpixels of the output image.

Although the description given above recites examples of subpixel data of the subpixels of the input image stored in the buffer memories 21A and 21B and the coefficients respectively assigned to the subpixels for an RGB type subpixel arrangement, the above-described SPR is also applicable to an RGBG type subpixel arrangement.

FIGS. 20A to 20F illustrate example relationships between subpixel data of subpixels of the input image stored in the buffer memories 21A and 21B and coefficients assigned to the subpixels of the input image, for an RGBG type subpixel arrangement. In FIGS. 20A to 20F, the regions which are used in calculating subpixel data of subpixels of the output image are indicated by broken lines, with respect to the R subpixels R11 to R16, R21 to R26, R31 to R36 and R41 to R46. Coefficients assigned to the subpixels of the input image are indicated in each region enclosed with the broken line. In one or more embodiments, the register 16 is configured to store not only coefficients for an RGB type subpixel arrangement but also coefficients for an RGBG type subpixel arrangement. In one or more embodiments, the SPR circuitry 20 is configured to selectively use the coefficients for an RGB type subpixel arrangement and the coefficients for an RGBG type subpixel arrangement, depending on the subpixel arrangement of the display panel 1.

Figure 20A:
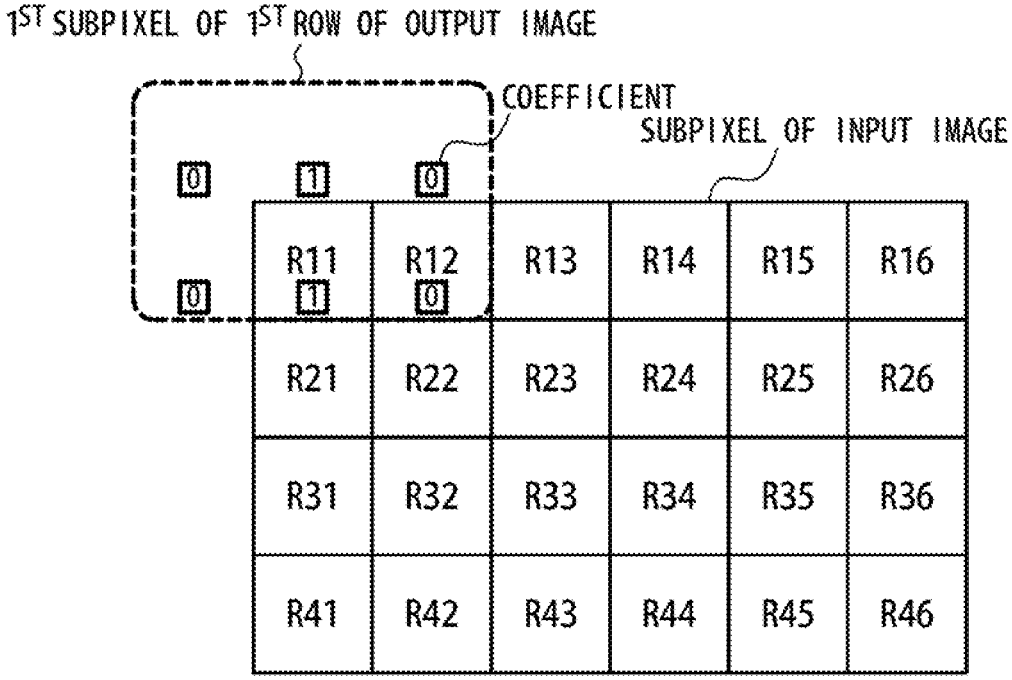
FIGS. 20A to 20F illustrate correspondence relationships between subpixels of an to-be-obtained output image of an RGBG type subpixel arrangement and subpixel data of subpixels of an input image stored in a buffer, according to one or more embodiments.
Figure 20B:
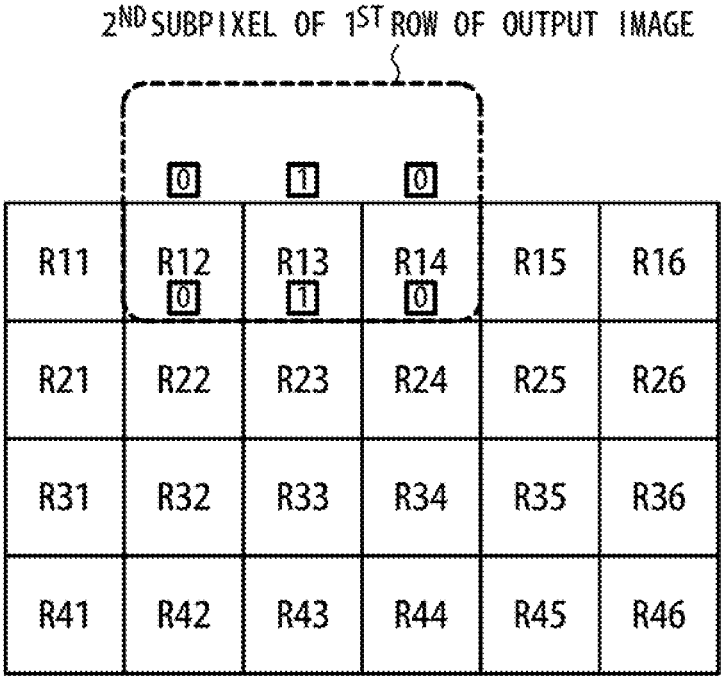
Figure 20C:
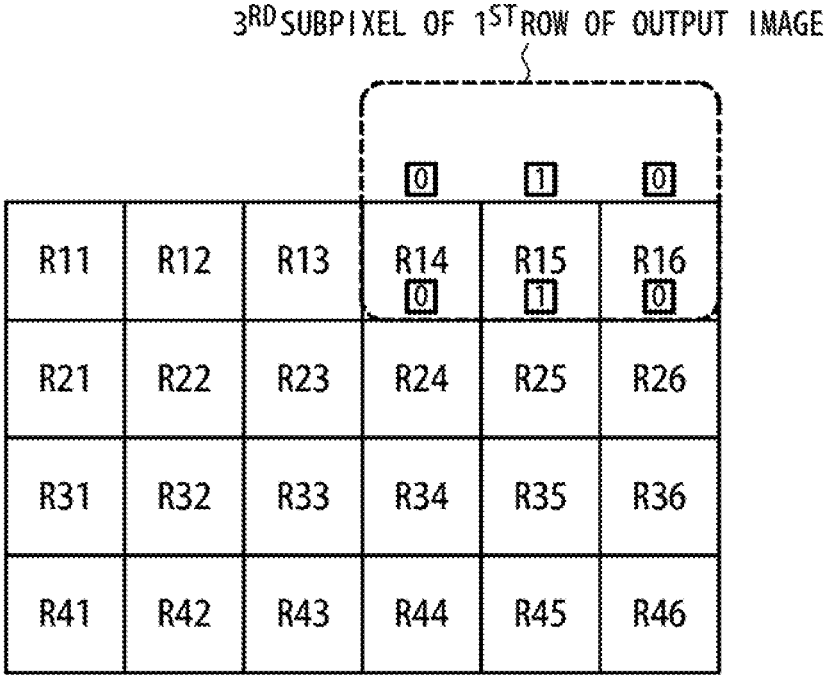
Figure 20D:
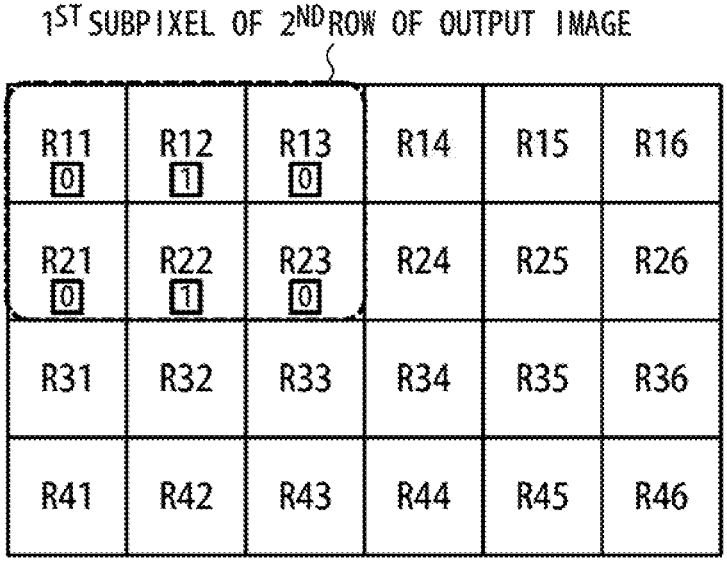
Figure 20E:
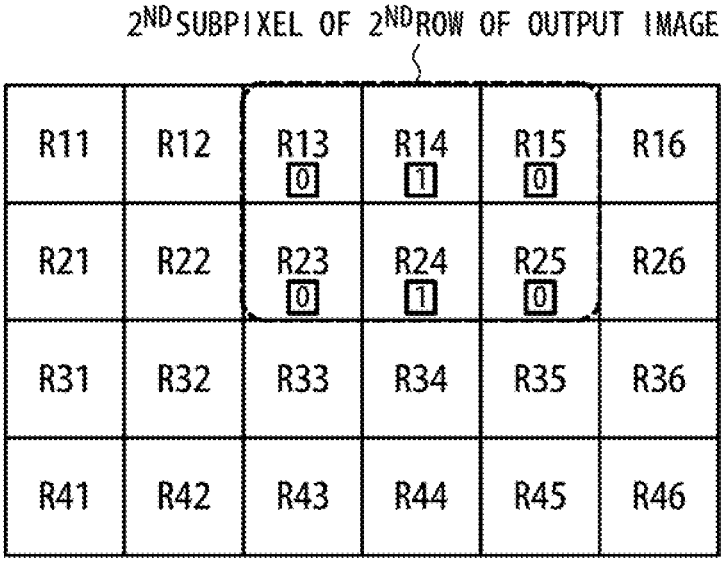
Figure 20F:
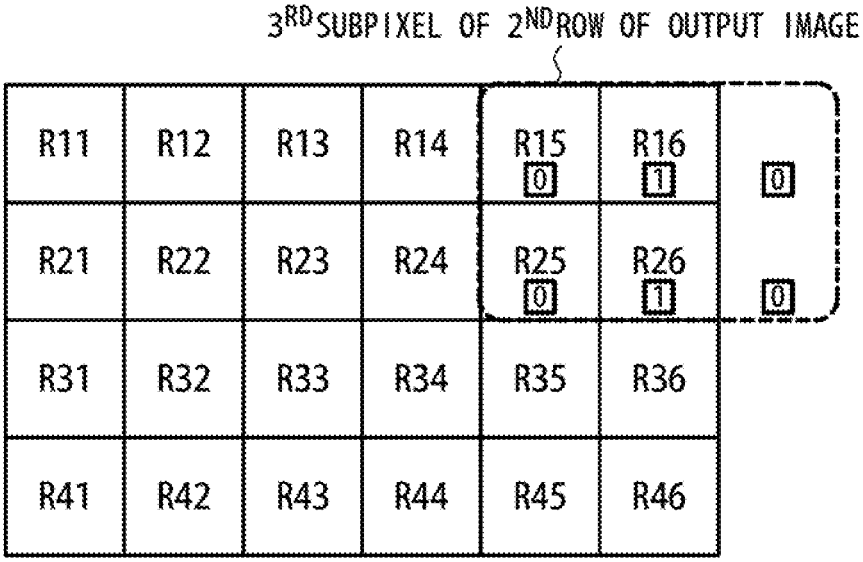

When the subpixel data for the first R subpixel of the first row of the output image is calculated, as illustrated in FIG. 20A, for example, the six subpixels in the region indicated by the broken line, which are encompassed in two lines of the input image, may be used. In the example illustrated in FIG. 20A, a first one of the buffer memories 21A and 21B, for example, the buffer memory 21A, may store subpixel data of "0", "0" and "0", as indicated in the top row from the left, and subpixel data of "0", "R11" and "R12" as indicated in the bottom row from the left, so that the subpixel data are associated with the positions of the six relevant subpixels encompassed in the region of the input image indicated by the broken line. The subpixel data of "0" illustrated in FIG. 20A may imply that there are no corresponding subpixels to be used in the input image. In one or more embodiments, as illustrated in FIG. 20A, the coefficients associated with the six relevant pixels of the input image are "0", "1" and "0", as indicated in the top row from the left, and "0", "1" and "0", as indicated in the bottom row from the left.

Similarly, FIGS. 20B to 20F illustrate relationships between subpixels of the input image stored in the buffer memories 21A and 21B and coefficients respectively assigned to the subpixels of the input image, in calculating the subpixel data of the second and third R subpixels in the first row of the output image and the first to third R subpixels in the second row, according to one or more embodiments.

Figure 21A:
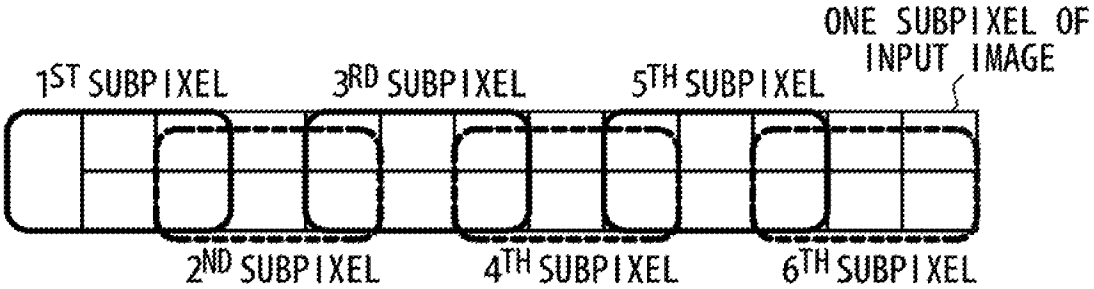
FIGS. 21A and 21B illustrate an example of inputting coefficients into a buffer for an RGBG type subpixel arrangement, according to one or more embodiments.
Figure 21B:
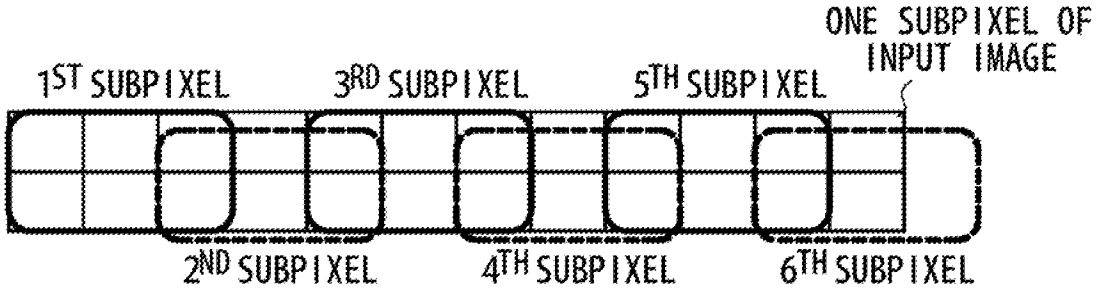

FIGS. 21A and 21B respectively illustrate, for an RGBG type subpixel arrangement, relationships between six subpixels of the input image which are used in calculating the subpixel data of each of subpixels in the even-numbered rows and the odd-numbered rows of the output image, and coefficients respectively associated with the respective subpixels of the input image, according to one or more embodiments. FIGS. 21A and 21B schematically illustrate subpixels of the input image which are used in calculating subpixel data of the first to sixth subpixels of each row of the output image according to one or more embodiments. Although FIGS. 21A and 21B illustrate the relationships between the subpixels of the input image and the coefficients for first to eighth subpixels of the output image in one or more embodiments, the regularity illustrated in FIGS. 21A and 21B may be applied to the seventh and other subpixels of the output image.

As thus described, the above-described procedure of SPR is also applicable to an RGBG type subpixel arrangement only by modifying, as illustrated in FIGS. 21A and 21B, the applying method of the coefficients to the subpixel data stored in the buffer memories for the RGB type subpixel arrangement, which is illustrated in FIGS. 19A and 19B.

As thus described, in one or more embodiments, the display driver 2 is configured so that each of the regions of the input image used in SPR is encompassed in two lines, and the display driver 2 comprises a pair of buffer memories 21A and 21B each configured to store subpixel data of six subpixels of the input image. This display driver 2 thus configures can perform SPR for various subpixel arrangements only by switching the coefficients associated with the buffer memories 21A and 21B.

Figure 22:
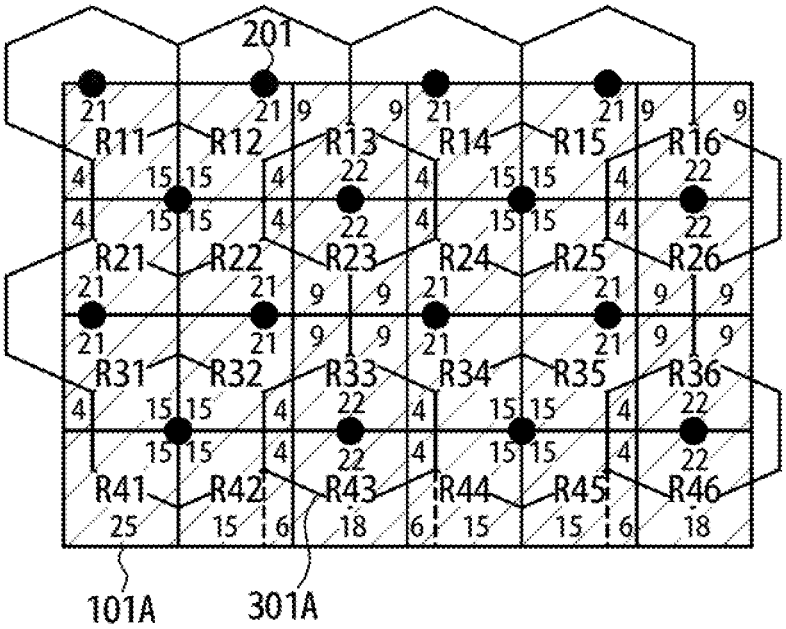
FIG. 22 illustrates example reference regions associated with geometric centers of R subpixels, according to one or more embodiments.

Although FIG. 8 illustrates the example in which the reference regions 301, which are associated with the geometric centers defined for the output image, are each defined as a quadrangle, such as a rhombus, the reference regions are not limited to be quadrangular. For example, as illustrated in FIG. 22, the reference regions, which are denoted by numerals 301A in FIG. 22, may be each defined as a hexagon. In one or more embodiments, as illustrated in FIG. 22, a reference region 301A associated with each geometric center 201 is defined so that the reference region 301A is encompassed in two lines of R subpixels 101A in the input image. In one or more embodiments, the SPR described with reference to FIGS. 6 to 14 is applied to this configuration. In one or more embodiments, the coefficients for the respective reference regions 301A as illustrated in FIG. 22 are determined based on the first to third conditions described above, and stored in the register 16. In one or more embodiments, as illustrated in FIG. 22, the reference regions 301A have reference patterns based on the shapes of the portions of the R subpixels 101A encompassed in the respective reference regions 301A. In one or more embodiments, these reference patterns repeat with a cycle of two subpixels in each odd-numbered row and in each even-numbered row. In one or more embodiments, a reference region may be variously shaped as long as the reference region is encompassed in two lines of subpixels in the input image, the two lines being associated with the relevant geometric center defined for the output image.

Although a limited number of embodiments have been described in the above, a skilled person benefited from this disclosure would appreciate that various other embodiments and variations may be conceived without departing from the scope of this disclosure. Embodiments and variations may be combined. Accordingly, the specification and drawings only provides an exemplary disclosure.

What is claimed is:

1. A display driver, comprising:

buffer memory circuitry configured to store first subpixel data for a plurality of first subpixels of input subpixels of an input image, wherein the plurality of first subpixels each are encompassed at least partially in a plurality of predetermined regions defined within two lines of input subpixels of the input image;

a register configured to store coefficients that respectively correspond to shapes of portions of the first subpixels encompassed in the predetermined regions, wherein for each of the predetermined regions, a first total of the coefficients of a first set of the portions of the first subpixels equals a second total of the coefficients of a second set of the portions of the first subpixels, wherein an adjacent two portions of the first set are diagonally arranged, and wherein an adjacent two portions of the second set are diagonally arranged; and subpixel rendering (SPR) circuitry configured to calculate second subpixel data for second subpixels of an output image based on the first subpixel data and the coefficients.

2. The display driver according to claim 1, wherein a total number of the second subpixels of the output image is two thirds of a total number of the input subpixels of the input image.

3. The display driver according to claim 1, wherein totals of the coefficients of the portions of the first subpixels encompassed in the respective predetermined regions are the same as each other.

4. The display driver according to claim 1, wherein a first third total of the coefficients assigned to one of the first subpixels is the same as a fourth total of the coefficients assigned to another one of the first subpixels.

5. The display driver according to claim 1, wherein the coefficients are determined based on areas of the respective portions of the first subpixels encompassed in the predetermined regions.

6. The display driver according to claim 1, wherein the SPR circuitry is further configured to calculate the second subpixel data of the second subpixels of the output image, based on second coefficients corresponding to shapes of portions of the first subpixels not encompassed in the predetermined regions.

7. The display driver according to claim 6, wherein the second coefficients are determined based on areas of the respective portions of the respective portions of the first subpixels not encompassed in the predetermined regions.

8. The display driver according to claim 1, wherein the predetermined regions in a row have two patterns of the coefficients, and wherein the buffer memory circuitry comprises a pair of buffer memories associated with the two patterns, respectively.

9. The display driver according to claim 8, wherein the two patterns in an odd-numbered row and the two patterns in an even-numbered row are different from each other, wherein the two patterns repeat with a cycle of two subpixels of the output image in each of the odd-numbered row and the even-numbered row.

10. The display driver according to claim 8, wherein the buffer memories each are configured to store the first subpixel data for six of the first subpixels.

11. The display driver according to claim 1, wherein each of the predetermined regions is a rhombus or a hexagon.

12. The display driver according to claim 1, wherein the predetermined regions are determined based on geometric centers of the second subpixels.

13. The display driver of claim 1, wherein totals of the coefficients of the portions of the first subpixels encompassed in the respective predetermined regions are the same as each other, and wherein a third total of the coefficients assigned to one of the first subpixels is the same as a fourth total of the coefficients assigned to another one of the first subpixels.

14. A display device, comprising:

a display panel; and a display driver configured to output an output image generated through subpixel rendering (SPR) on the display panel, wherein the display driver comprises:

buffer memory circuitry configured to store first subpixel data for a plurality of first subpixels of input subpixels of an input image, wherein the plurality of the first subpixels each are encompassed at least partially in a plurality of predetermined regions defined within two lines of input subpixels of the input image;

a register configured to store coefficients that respectively correspond to shapes of portions of the first subpixels encompassed in the predetermined regions, wherein for each of the predetermined regions, a first total of the coefficients of a first set of the portions of the first subpixels equals a second total of the coefficients of a second set of the portions of the first subpixels, wherein an adjacent two portions of the first set are diagonally arranged, and wherein an adjacent two portions of the second set are diagonally arranged; and SPR circuitry configured to calculate second subpixel data of second subpixels of an output image, based on the first subpixel data and the coefficients.

15. The display device according to claim 14, wherein a total number of the second subpixels of the output image is two thirds of a total number of the input subpixels of the input image.

16. The display device according to claim 14, wherein totals of the coefficients of the portions of the first subpixels encompassed in the respective predetermined regions are the same as each other.

17. The display device according to claim 14, wherein a third total of the coefficients assigned to one of the first subpixels is the same as a fourth total of the coefficients assigned to another one of the first subpixels.

18. The display device according to claim 14, wherein the predetermined regions in a row have two patterns of the coefficients, and wherein the buffer memory circuitry comprises a pair of buffer memories associated with the two patterns, respectively.

19. The display device according to claim 18, wherein the two patterns in an odd-numbered row and the two patterns in an even-numbered row are different from each other, wherein the two patterns repeat with a cycle of two subpixels of the output image in each of the odd-numbered row and the even-numbered row.

20. A method for subpixel rendering, comprising:

receiving input image data comprising input subpixels;

storing first subpixel data for a plurality of first subpixels of the input subpixels, wherein each of the plurality of first subpixels is encompassed at least partially in a plurality of predetermined regions defined within two adjacent lines of the input subpixels;

storing coefficients corresponding to shapes of portions of the plurality of first subpixels that are encompassed in the plurality of predetermined regions, wherein for each of the predetermined regions, a first total of the coefficients of a first set of the portions of the first subpixels equals a second total of the coefficients of a second set of the portions of the first subpixels, wherein an adjacent two portions of the first set are diagonally arranged, and wherein an adjacent two portions of the second set are diagonally arranged; and generating, based on the first subpixel data and the coefficients, output image data comprising second subpixel data for second subpixels.

21. The method of claim 20, wherein storing the coefficients comprises:

determining first coefficients for a first region and second coefficients for a second region of the plurality of predetermined regions according to one or more predetermined conditions.

22. The method of claim 20, wherein totals of the coefficients of the portions of the first subpixels encompassed in the respective predetermined regions are the same as each other, and wherein a third total of the coefficients assigned to one of the first subpixels is the same as a fourth total of the coefficients assigned to another one of the first subpixels.

* * * * *